US008763169B2

(12) United States Patent
Daniels et al.

(10) Patent No.: US 8,763,169 B2
(45) Date of Patent: Jul. 1, 2014

(54) ELEVATED TOILET SEAT ASSEMBLY

(75) Inventors: James Leroy Daniels, Stokesdale, NC (US); Earl David Forrest, Asheboro, NC (US)

(73) Assignee: Liberty Hardware Mfg. Corp., Winston-Salem, NC (US)

( * ) Notice: Subject to any disclaimer, the term of this patent is extended or adjusted under 35 U.S.C. 154(b) by 1647 days.

(21) Appl. No.: 12/038,072

(22) Filed: Feb. 27, 2008

(65) Prior Publication Data

US 2009/0211004 A1 Aug. 27, 2009

(51) Int. Cl.
*A47K 13/00* (2006.01)
*A47K 13/12* (2006.01)

(52) U.S. Cl.
USPC ..... 4/239; 4/240

(58) Field of Classification Search
USPC ..... 4/234–240, 254; 403/322.4, DIG. 14; 292/DIG. 47
See application file for complete search history.

(56) References Cited

U.S. PATENT DOCUMENTS

| | | | | | |
|---|---|---|---|---|---|
| 169,948 | A | * | 11/1875 | Bond | 403/322.4 |
| 2,221,991 | A | * | 11/1940 | Myers et al. | 4/239 |
| 3,061,368 | A | * | 10/1962 | Matthews | 297/118 |
| 4,578,829 | A | | 4/1986 | Lenosky | |
| 4,964,179 | A | | 10/1990 | Kimes | |
| 5,141,354 | A | * | 8/1992 | Morsbach | 403/322.4 |
| 5,778,460 | A | * | 7/1998 | Doell et al. | 4/239 |
| 6,464,423 | B1 | * | 10/2002 | Klein | 403/322.4 |
| 7,093,308 | B2 | | 8/2006 | Berlovan et al. | |
| 2009/0013453 | A1 | * | 1/2009 | Landsberger et al. | 4/236 |

* cited by examiner

*Primary Examiner* — Huyen Le
*Assistant Examiner* — Christine Skubinna
(74) *Attorney, Agent, or Firm* — Carlson, Gaskey & Olds

(57) ABSTRACT

A bracket assembly for an elevated toilet seat includes a first bracket and a second bracket. The first bracket includes an opening, and the second bracket includes a cam that selectively engages the opening. The cam is rotatable between a first position and a second position to engage the first bracket relative to the second bracket.

11 Claims, 4 Drawing Sheets

ELEVATED TOILET SEAT ASSEMBLY

BACKGROUND OF THE INVENTION

This disclosure relates generally to a toilet seat, and more particularly to an elevated toilet seat assembly.

Modern bathrooms are equipped with toilets having toilet seats that provide a relatively comfortable surface for individuals to utilize the facilities of the bathroom. Individuals with balance and mobility issues, such as the elderly or persons having temporary or permanent physical impairments, may have difficulty sitting on and raising from a conventional toilet seat. For example, these individuals may lack the muscles required to safely reach the toilet seat, possibly resulting in harm to the individual.

Elevated toilet seats are known that provide a raised surface to allow individuals with physical impairments to reach the toilet seat with less exertion than required with a conventional toilet seat. These elevated toilet seats typically include locking mechanisms for securing the elevated seat relative to the toilet. For example, one known elevated toilet seat includes a knob that is rotatable to engage a hook on the inside of the toilet bowl rim.

Disadvantageously, known elevated toilet seats are difficult to install and remove from the existing toilet. Typically, the tools are required to remove the elevated seat from the toilet. Additionally, elevated toilet seat designs that include rotatable knobs that engage hooks on the interior of the toilet bowl rim may be an intrusion because the knob protrudes into the living space. The components that engage the inside of the toilet bowl rib can be nauseating to clean as these extra surfaces can collect mold, fecal matter, urine and the like.

Accordingly, it is desirable to provide an elevated toilet seat that is easy to clean, easy to install and remove, and that is installable on existing toilet bowls of various shapes and sizes.

SUMMARY OF THE INVENTION

A bracket assembly for an elevated toilet seat includes a first bracket and a second bracket. The first bracket includes an opening. The second bracket includes a cam that selectively engages the opening. The cam is rotatable between a first position and a second position to engage the first bracket relative to the second bracket.

An elevated toilet seat assembly for a toilet bowl having an upper rim includes a toilet seat and a bracket assembly. The bracket assembly includes a first bracket and a second bracket. The first bracket is mounted to one of the toilet seat and the upper rim, and the second bracket is mounted to the other of the toilet seat and the upper rim. The second bracket includes a cam that is rotatable to selectively engage the first bracket relative to the second bracket to removably secure the toilet seat relative to the upper rim.

A method for providing an elevated seating surface for a toilet bowl includes attaching one of a first bracket and a second bracket to a toilet seat, attaching the other of the first bracket and the second bracket to an upper rim of a toilet bowl, and manipulating a cam of the second bracket to selectively engage the second bracket relative to the first bracket.

The various features and advantages of this disclosure will become apparent to those skilled in the art from the following detailed description. The drawings that accompany the detailed description can be briefly described as follows.

DETAILED DESCRIPTION OF THE DISCLOSED EMBODIMENT

Figure 1:
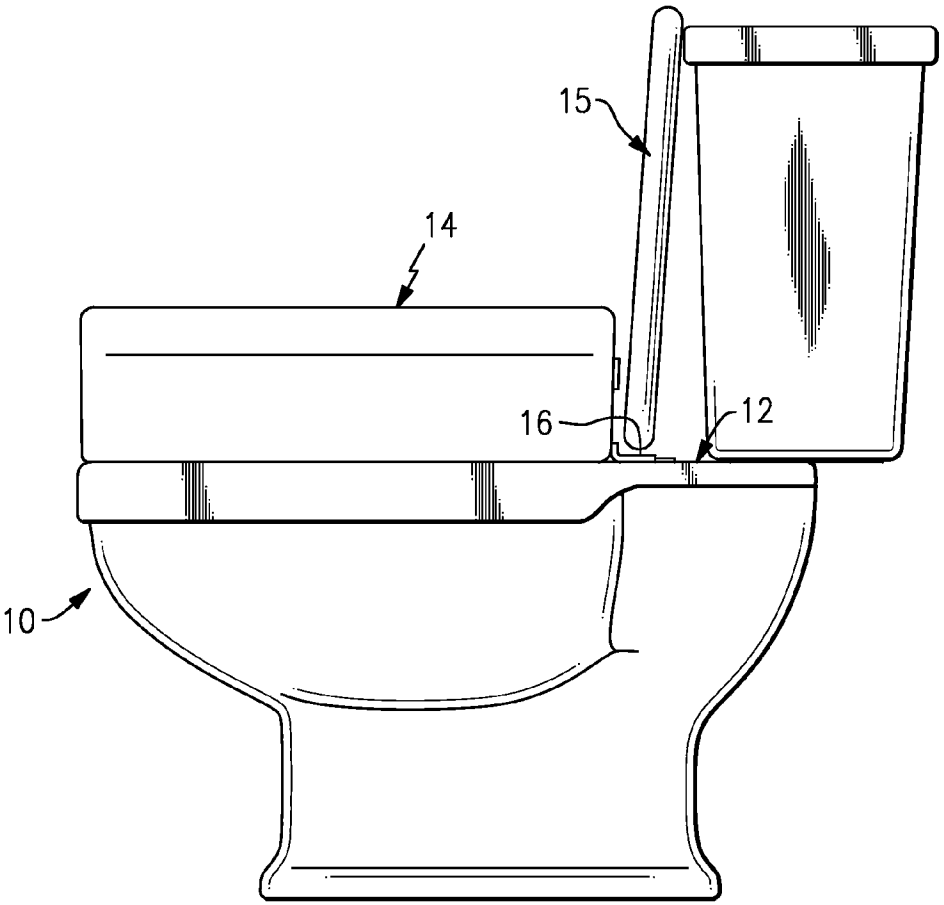
FIG. 1 illustrates a toilet bowl including an elevated toilet seat assembly.

FIG. 1 illustrates a toilet bowl 10 having an upper rim 12. A conventional toilet seat 15 is mounted to the upper rim 12 in a known manner. An elevated toilet seat assembly 14 is disposed above the upper rim 12 of the toilet bowl 10 at an elevated position. The elevated toilet seat assembly 14 comprise an elevated surface for individuals with balance and mobility issues, such as the elderly and the disabled, for example. The elevated toilet seat assembly 14 is removably attached to the upper rim 12 of the toilet bowl 10 via a bracket assembly 16, as is further discussed below.

Figure 2A:
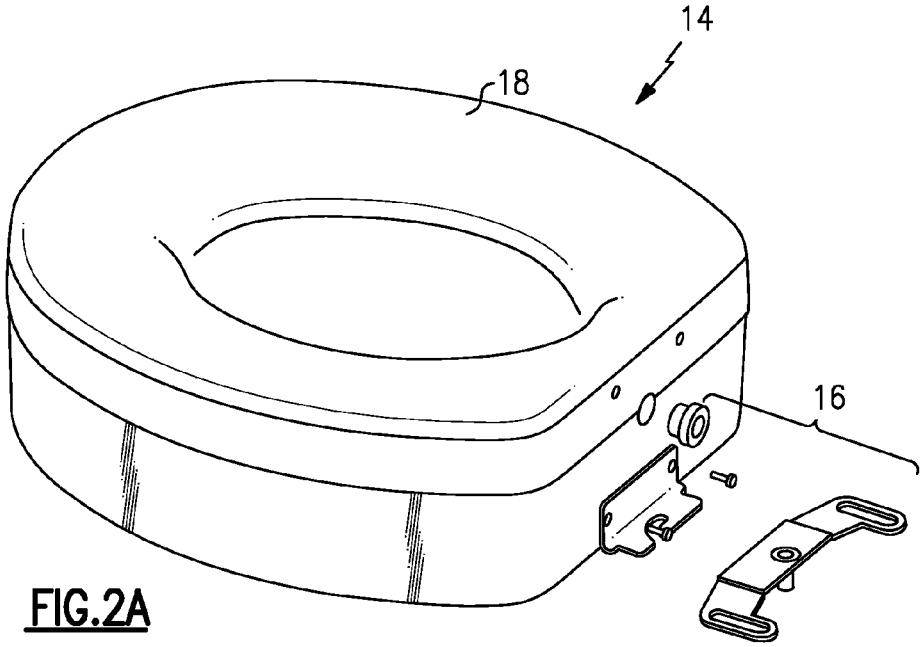
FIG. 2A illustrates one example elevated toilet seat assembly for use with the toilet bowl illustrated in FIG. 1.
Figure 2B:
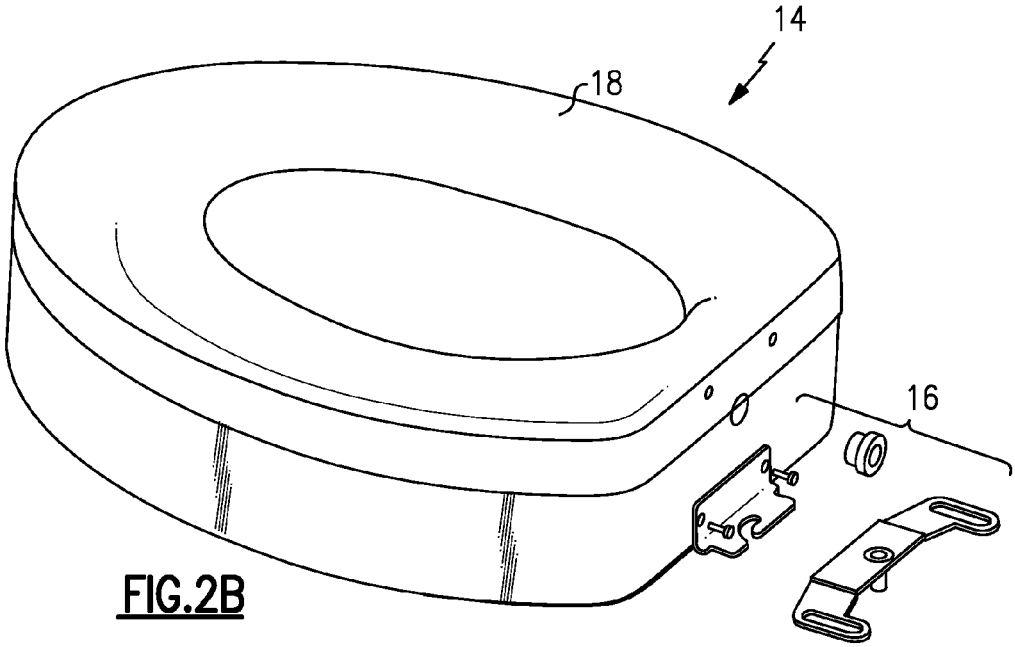
FIG. 2B illustrates another example elevated toilet seat assembly for use with the toilet bowl illustrated in FIG. 1.

FIG. 2A illustrates an example elevated toilet seat assembly 14. The elevated toilet seat assembly 14 includes a toilet seat 18 and the bracket assembly 16. In this example, the toilet seat 18 includes a round (standard) shaped design. In another example, the toilet seat 18 includes an elongated design (see FIG. 2B). The toilet seat 18 of the elevated toilet seat assembly 14 is made from a blow molded polyethylene plastic, in one example. It should be understood that the size, shape and material composition of the elevated toilet seat assembly 14 will vary depending upon design specific parameters, including but not limited to, the size and shape of the toilet bowl 10 and the amount of elevation above the toilet bowl 10 that is desired.

Figure 3A:
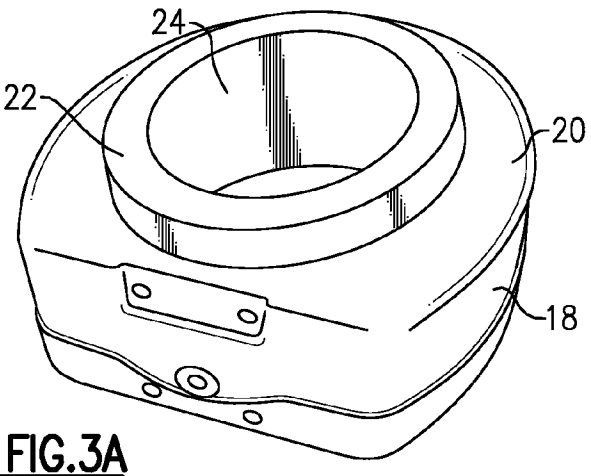
FIGS. 3A and 3B illustrate bottom views of example elevated toilet set assemblies.
Figure 3B:
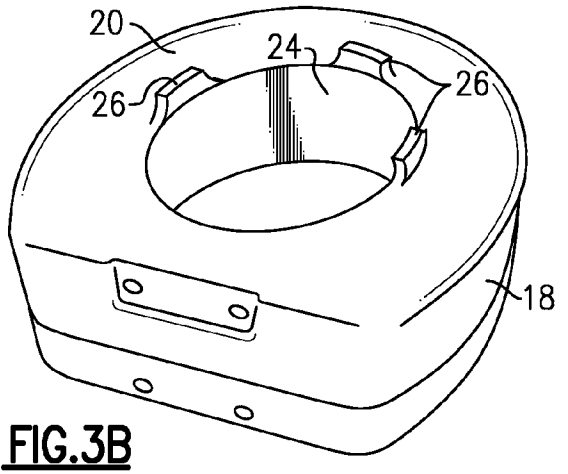

FIG. 3A illustrates a bottom surface 20 of the toilet seat 18 of the elevated toilet seat assembly 14. The bottom surface 20 includes a step 22. The step 22 engages the toilet seat 18 relative to the toilet bowl 10. In this example, the step 22 annularly extends about an entire opening 24 of the toilet seat assembly 14. In another example, the bottom surface 20 includes a plurality of standoffs 26 positioned about the opening 24 (see FIG. 3B). The standoffs 26 also engage the elevated toilet seat assembly 14 relative to the toilet bowl 10. Both the step 22 and the standoffs 26 include smooth surfaces that are relatively easy to clean.

Figure 4:
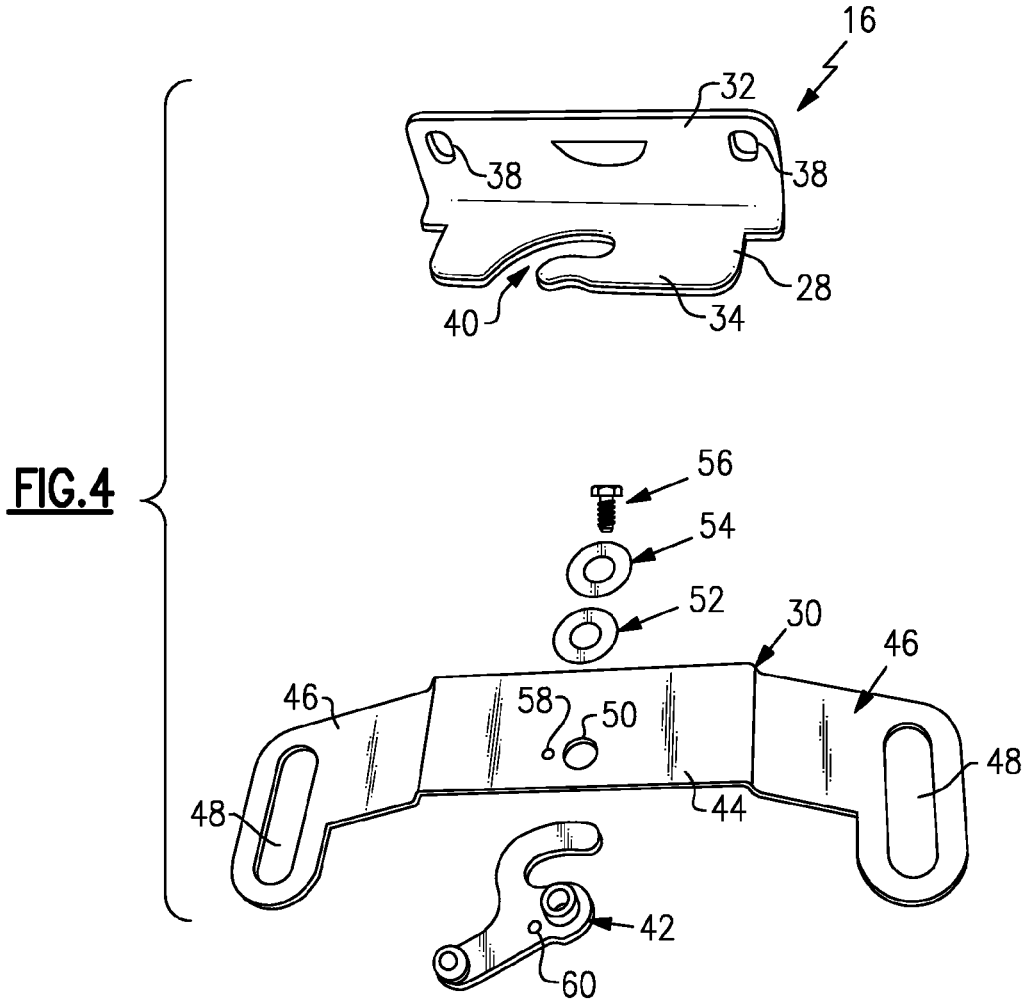
FIG. 4 illustrates an example bracket assembly of the elevated toilet seat assemblies illustrated in FIGS. 2A and 2B.
Figure 5:
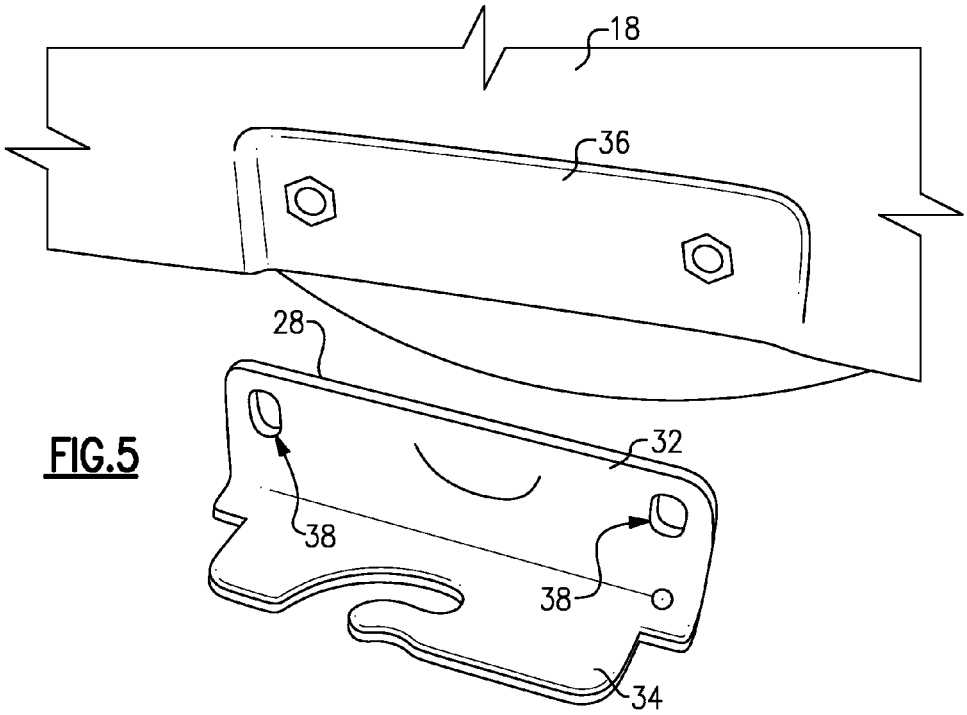
FIG. 5 illustrates an exploded view of a portion of the bracket assembly illustrated in FIG. 4 relative to an elevated seat.
Figure 6:
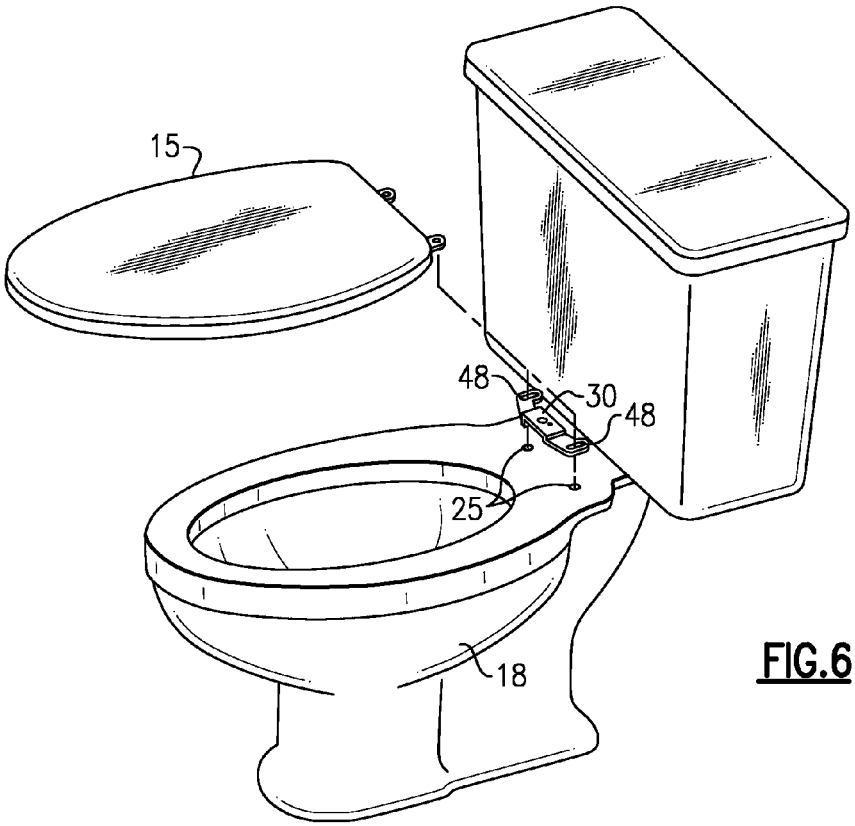
FIG. 6 illustrates an exploded view of a portion of the bracket assembly illustrated in FIG. 4 relative to an upper rim of a toilet bowl.

FIG. 4 illustrates an example bracket assembly 16 for removably attaching the elevated toilet seat assembly 14 relative to the upper rim 12 of the toilet bowl 10. The bracket assembly 16 includes a first bracket 28 and a second bracket 30. In this example, the first bracket 28 is attached to the toilet seat 18 of the elevated toilet seat assembly 14 (See FIG. 5), and the second bracket 30 is attached to the upper rim 12 of the toilet bowl 10 (see FIG. 6). However, it should be understood that an opposite configuration is possible in which the second bracket 30 is attached to the toilet seat 18, and the first bracket 28 is attached to the upper rim 12 of the toilet bowl 10.

The first bracket 28 includes a first face 32 and a second face 34. In this example, the first face is angled relative to the second face 34. The second face 34 is transversely angled relative to the first face 32 such that an angle of 180 degrees is defined between the bottom surface 20 and the second face 34, in one example. The first face 32 is received and secured against a recess 36 of the toilet seat 18 of the elevated toilet seat assembly 14 (see FIG. 5). The second face 34 extends parallel to the upper rim 12 of the toilet bowl 10 when the first bracket 28 is secured to the toilet seat 18.

The first face 32 of the first bracket 28 includes openings 38. In one example, the openings 38 are elongated. The elongated openings 38 provide necessary adjustment of the first bracket 28 relative to the toilet seat 18 to accommodate toilet bowls 10 having variations in the flatness of the upper rim 12. That is, the height of the first bracket 28 relative to the toilet seat 18 and the upper rim 12 is adjustable via the openings 38.

The second face 34 of the first bracket 28 includes an opening 40. In this example, the opening 40 is a slot. The slot is generally quarter donut shaped, in one example. The opening 40 receives a cam 42 of the second bracket 30 to removably secure the toilet seat 18 relative to the upper rim 12, as is further discussed below.

The second bracket 30 includes a middle flange 44 disposed between a pair of bracket arms 46. The bracket arms include slots 48 that are utilized to secure the second bracket 30 relative to the upper rim 12 of the toilet bowl 10 (see FIG. 6). In one example, the second bracket 30 is positioned between the upper rim 12 of the toilet bowl 10 and the conventional toilet seat 15 of the toilet bowl 10 (see FIG. 6). The second bracket 30 is secured to the upper rim 12 with openings 25 that extend into the upper rim 12 and are used to attach the conventional toilet seat 15 of the toilet bowl 10.

The middle flange 44 of the second bracket 30 includes an opening 50 for receiving the cam 42. A wave spring washer 52, a washer 54 and a fastener 56 are positioned on an opposite side of the middle flange 44 from the cam 42 to securely attach the cam 42 to the second bracket 30. The middle flange 44 also includes a hole 58 for receiving a domed protrusion 60 of the cam 42 to lock the cam 42 relative to the second bracket 30.

Figure 7:
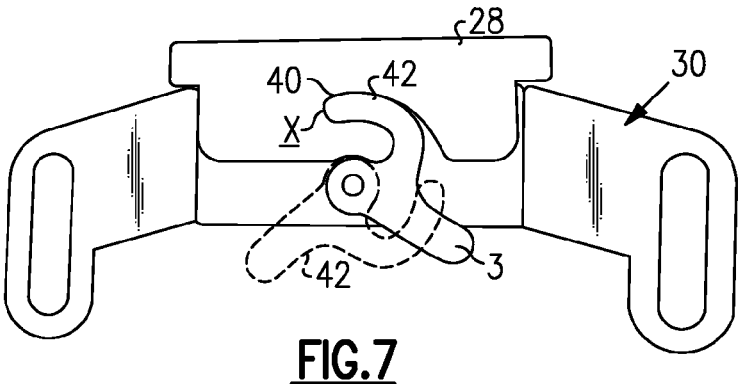
FIG. 7 illustrates another view of the example bracket assembly illustrated in FIG. 4.

FIG. 7 schematically illustrates operation of the bracket assembly 16 to remove/attach the elevated toilet seat assembly 14 relative to the toilet bowl 10. The middle flange 44 of the second bracket 30 is slightly elevated relative to the bracket arms 46 for receiving the second face 34 of the first bracket 28 thereunder. That is, the second face 34 is slid to a position under and adjacent to the middle flange 44 to position the first bracket 28 relative to the second bracket 30.

The cam 42 is selectively manipulated between a first position X and a second position X' (shown in phantom lines) to engage/disengage the first bracket 28 relative to the second bracket 30 of the bracket assembly 16. For example, the cam 42 may be gripped and rotated to engage/disengage the first bracket 28 relative to the second bracket 30. In this example, the first position X represents a locked position in which the elevated toilet seat assembly 14 is securely attached to the toilet bowl 10. The second position X' represents an unlatched position in which the first bracket 28 is released relative to the second bracket 30 and the elevated toilet seat assembly 14 is removable from the toilet bowl 10.

In the first position X, the domed protrusion 60 is received within the hole 58 of the middle flange 44 to securely lock the cam 42 and secure the first bracket 28 relative to the second bracket 30. The cam 42 is selectively rotatable, in one example, to the second position X' to release the cam 42 and disengage the first bracket 28 relative to the second bracket 30. The hole 58 includes a slight chamfer that leads the domed protrusion 60 out of the hole 58 to release the cam 42. In one example, the cam 42 is rotated 90° to release the first bracket 28 relative to the second bracket 30. The conventional toilet seat 15 can resume normal function once the elevated toilet seat assembly 14 is unlocked and removed from the toilet bowl 10.

The foregoing description shall be interpreted as illustrative and not in any limiting sense. A worker of ordinary skill in the art having the benefit of this disclosure would understand that certain modifications would come within the scope of the disclosure. For these reasons, the following claims should be studied to determine the true scope and content of the disclosure.

What is claimed is:

1. An elevated toilet seat assembly for a toilet bowl including an upper rim, comprising:

a toilet seat; and a bracket assembly including a first bracket mounted to one of said toilet seat and the upper rim, and a second bracket mounted to other of said toilet seat and the upper rim, wherein said second bracket includes a cam that is rotatable to selectively engage a slot of said first bracket to removeably secure said toilet seat relative to the upper rim; wherein one of said first bracket and said second bracket is mounted between the upper rim and a conventional toilet seat of the toilet bowl and the other of said first bracket and said second bracket is mounted within a recess of said toilet seat.

2. The assembly as recited in claim 1, wherein said toilet seat is disposed above the toilet bowl at an elevated position.

3. The assembly as recited in claim 1, wherein said cam is rotatable between a first position and a second position, and said first position is a locked position and said second position is an unlocked position.

4. The assembly as recited in claim 3, wherein said second position is 90° relative to said first position.

5. The assembly as recited in claim 1, wherein one of said first bracket and said second bracket includes openings for adjusting a height of one of said first bracket and said second bracket relative to said toilet seat and the upper rim.

6. A method for providing an elevated seating surface for a toilet bowl having an upper rim, a toilet seat, and a bracket assembly including a first bracket and a second bracket, the method comprising the steps of:

a) attaching one of the first bracket and the second bracket to the toilet seat including mounting one of the first bracket and the second bracket within a recess of the toilet seat;

b) attaching the other of the first bracket and the second bracket to the upper rim; and c) manipulating a cam of the second bracket to selectively engage a slot of the first bracket.

7. A method for providing an elevated seating surface for a toilet bowl having an upper rim, a toilet seat, and a bracket assembly including a first bracket and a second bracket, the method comprising the steps of:

a) attaching one of the first bracket and the second bracket to the toilet seat including mounting one of the first bracket and the second bracket within a recess of the toilet seat;

b) attaching the other of the first bracket and the second bracket to the upper rim including mounting the other of the first bracket and the second bracket between the upper rim and a conventional toilet seat of the toilet bowl; and c) manipulating a cam of the second bracket to selectively engage a slot of the first bracket.

8. The assembly as recited in claim 1, wherein a bottom surface of said toilet seat includes a step.

9. The assembly as recited in claim 1, wherein said second bracket includes a middle flange disposed between a pair of bracket arms.

10. The assembly as recited in claim 9, wherein said middle flange is elevated relative to said pair of bracket arms.

11. The assembly as recited in claim 9, wherein said middle flange includes a hole and said cam includes a domed protrusion, wherein said domed protrusion is received within said hole to lock said cam relative to said second bracket.

* * * * *